US005343623A

United States Patent [19]

Cole et al.

[11] Patent Number: 5,343,623

[45] Date of Patent: Sep. 6, 1994

[54] KNIFE ASSEMBLY FOR CUTTING A FOOD PRODUCT

[75] Inventors: Eugene H. Cole; Charles Rowell, both of Valparaiso, Ind.

[73] Assignee: Urschel Laboratories, Inc., Valparaiso, Ind.

[21] Appl. No.: 881,292

[22] Filed: May 11, 1992

[51] Int. Cl.[5] ..... B26B 3/04; B26B 3/00; B26D 7/01

[52] U.S. Cl. ..... 30/304; 30/299; 83/468.1

[58] Field of Search ..... 30/165, 172, 279, 287, 30/299, 304; 83/444, 466.1, 468

[56] References Cited

U.S. PATENT DOCUMENTS

| | | | |
|---|---|---|---|
| 1,357,829 | 11/1920 | Anstice . | |
| 1,866,960 | 7/1932 | Zimmer | 83/468.1 |
| 2,621,691 | 12/1952 | Brualdi | 83/468.1 |
| 2,645,262 | 7/1953 | Marasco . | |
| 2,883,748 | 4/1959 | Mora | 30/304 |
| 3,463,211 | 8/1969 | Holz . | |
| 4,092,972 | 6/1978 | Schmid . | |
| 4,625,364 | 12/1986 | Adams | 30/304 |
| 4,669,186 | 6/1987 | Liu et al. | 30/299 |
| 4,733,588 | 3/1988 | Yamamoto . | |
| 4,766,793 | 8/1988 | Fischer et al. . | |
| 4,972,750 | 11/1990 | Paavola . | |
| 5,044,240 | 9/1991 | Fischer et al. . | |
| 5,063,674 | 11/1991 | Rowell | 30/299 |
| 5,069,100 | 12/1991 | Jackson . | |

FOREIGN PATENT DOCUMENTS

| | | |
|---|---|---|
| 0221340 | 5/1987 | European Pat. Off. . |
| 641424 | 1/1937 | Fed. Rep. of Germany . |
| 833676 | 2/1952 | Fed. Rep. of Germany . |
| 653099 | 3/1929 | France . |
| 1193331 | 11/1959 | France . |
| 55926 | 9/1943 | Netherlands . |
| WO89/09684 | 10/1989 | World Int. Prop. O. . |

*Primary Examiner*—Richard K. Seidel
*Assistant Examiner*—Paul M. Heyrana
*Attorney, Agent, or Firm*—Bacon & Thomas

[57] ABSTRACT

A knife blade and knife blade assembly are disclosed for cutting food products into sticks or slices without causing surface cracking. The knife blade has a cutting portion defining a cutting edge and is mounted in the knife assembly such that a tension force is exerted on the knife blade in the plane of the cutting edge. The cutting edge of the knife blade is not sharp, but is generally flat and extends between parallel sides of the knife blade. The individual knife blades are formed of stainless steel and are electro-polished to remove any surface defects or sharp edges which may produce stress concentrations. This enables a significant tension force to be applied to the knife blade without diminishing its useful life. The electro-polishing process may also round off the corners of the juncture between the flat cutting edge and the parallel knife blade sides.

20 Claims, 3 Drawing Sheets

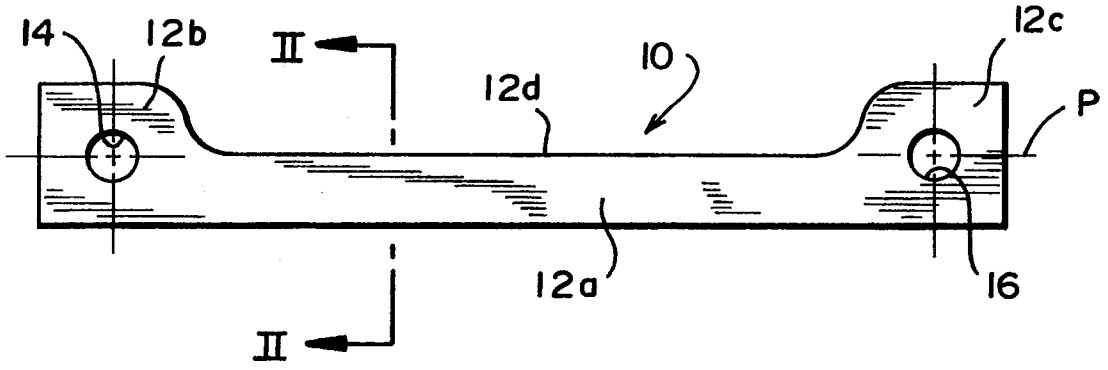
FIG. 1
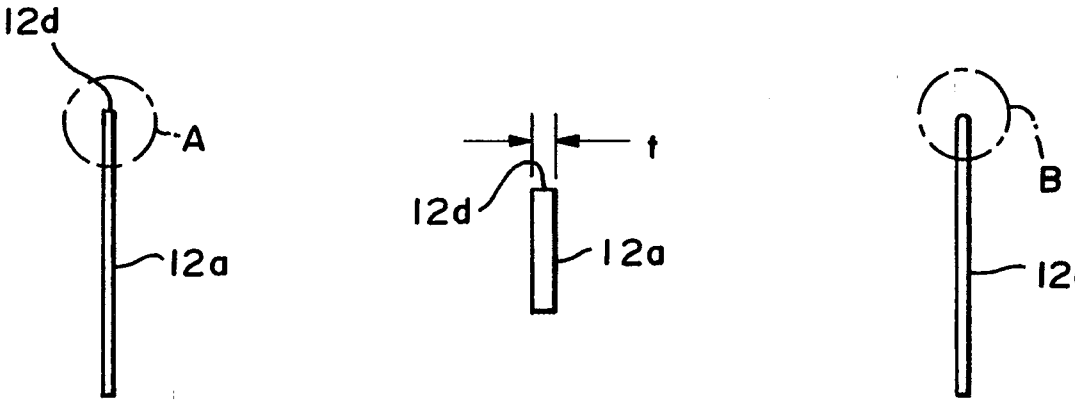
FIG. 2
FIG. 3
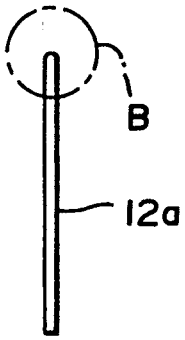
FIG. 4
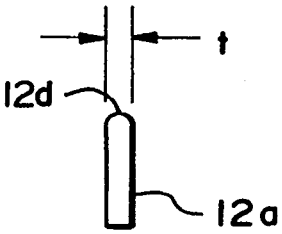
FIG. 5

KNIFE ASSEMBLY FOR CUTTING A FOOD PRODUCT

BACKGROUND OF THE INVENTION

The present invention relates to a knife blade and a knife blade assembly for cutting a food product into sticks or slices.

Devices for cutting food products into slices or sticks are well-known in the art and typically comprise a stationary array of cutting knives with a means to propel the food product through the knife array. The food product may be conveyed through the knife array by entraining it in a fluid stream, such as water, or by placing it between opposed conveyors as in U.S. Pat. No. 5,044,240.

Typically the stationary knife array comprises a plurality of knife blades mounted parallel to each other. If the food product is to be cut into slices, only a single such array need be utilized. However, if the food product is to be cut into sticks, such as potatoes for french fries, two such arrays are utilized with the knives in one array extending generally perpendicular to the knives in the other array. A typical knife assembly is disclosed in U.S. Pat. No. 4,766,793.

Although the known knife assemblies have proven generally successful, they have not proven successful in cutting certain food products, such as carrots and brittle potatoes, into sticks or slices. The known knife arrays have caused cracking of the surfaces of the products, known in the industry as "feathering" or "shattering", which results in an unacceptable product.

The individual knife blades used in the known knife arrays have had sharp cutting edges, usually formed by beveling one side of the knife blade.

SUMMARY OF THE INVENTION

A knife blade and knife blade assembly are disclosed for cutting food products into sticks without causing surface cracking of the sticks. The knife blade has a cutting portion defining a cutting edge and is mounted in the knife assembly such that a tension force is exerted on the knife blade in the plane of the cutting edge. The cutting edges of knives in the array are located in a common plane.

The cutting edge of the knife blade is not sharp, but is generally flat and extends between parallel sides of the knife blade.

The individual knife blades are formed of stainless steel and are electro-polished to remove any surface defects or sharp edges which may produce stress concentrations. This enables a significant tension force to be applied to the knife blade without diminishing its useful life. The electro-polishing process may also round off the corners of the juncture between the flat cutting edge and the parallel knife blade sides.

Through much experimentation with knife-blades having various sizes and cross-sectional configurations, it has been found that the knife blade according to this invention can reliably cut food products, such as potatoes and carrots into sticks without causing cracking of the surface of the sticks.

BRIEF DESCRIPTION OF THE DRAWINGS

FIG. 1 is a side view of a knife blade according to the present invention.

FIG. 2 is a cross-sectional view of the knife blade taken along line II—II in FIG. 1.

FIG. 3 is an enlarged view of area A in FIG. 2 illustrating the cutting edge of the knife blade.

FIG. 4 is a cross-sectional view, similar to FIG. 2, of a knife blade having a cutting edge with its edges rounded off.

FIG. 5 is an enlarged view of area B in FIG. 4 illustrating the cutting edge.

DETAILED DESCRIPTION OF THE PREFERRED EMBODIMENT

The knife blade according to the present invention is illustrated at 10 in FIG. 1 and comprises a cutting portion 12*a* with mounting portions 12*b* and 12*c* formed at either end of the cutting portion. Cutting portion 12*a* has a cutting edge 12*d* which extends generally along plane P. Mounting portions 12*b* and 12*c* define holes 14 and 16 adapted to accommodate means for attaching the knife blade to a mounting member, to be hereinafter described in more detail. The centers of mounting holes 14 and 16 also lie in plane P.

The knife blade of the invention is formed of 301 High Yield stainless steel. This type of stainless steel has both nickel and chromium, and has a tensile strength in excess of 300,000 psi. It also has a yield strength that is approximately equal to its tensile strength.

As illustrated in FIGS. 2 and 3, the cutting edge 12*d* is formed as a generally flat surface extending along plane P. The cutting portion 12*a* is formed with opposite parallel sides and may have a thickness t of between 0.005 and 0.015 inch. It has been found that a thickness t of 0.007 to 0.010 inch gives the most satisfactory results.

As noted previously, the knife blade 10 undergoes an electro-polishing operation in order to finely polish all of the surfaces to remove any minute cracks or flaws which may form stress concentration points. The electro-polishing operation may also round off the edges where the cutting edge 12*d* joins the opposite parallel sides of the cutting portion 12*a* of the knife blade, as illustrated in FIGS. 4 and 5. The electro-polishing operation also rounds off the sharp edges where holes 14 and 16 pass through the sides of the mounting portions 12*b* and 12*c*, respectively. In order to eliminate knife blade flexing and make straight cuts through the food product, it has been found that a very high lengthwise tension must be placed on each of the knife blades. The electro-polishing operation eliminates all of the stress concentration points on the knife blade to enable the tension to be applied without diminishing the operational life of the knife blades.

Figure 6:
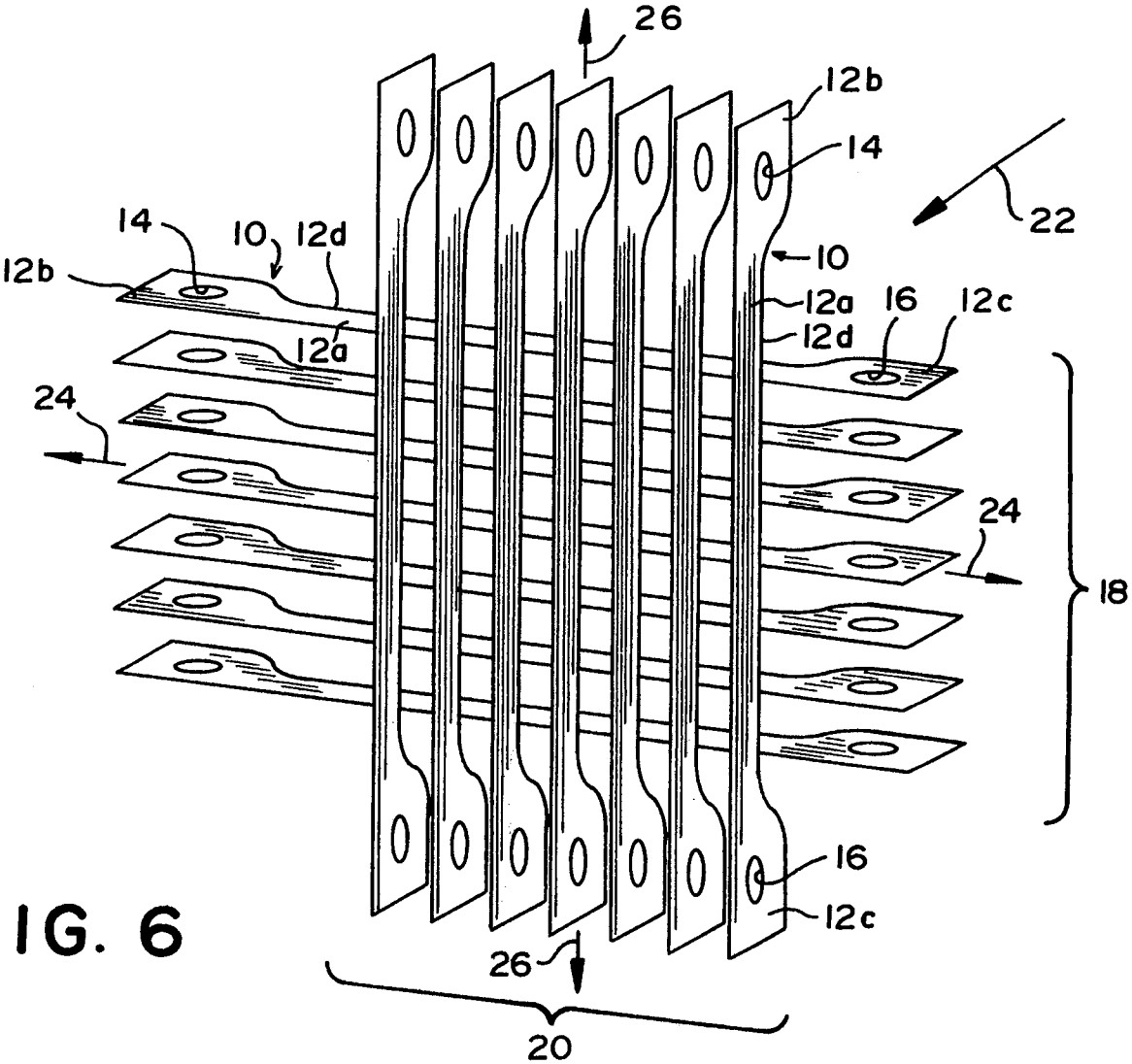
FIG. 6 is a schematic view of a pair of knife arrays arranged in an orthogonal pattern so as to cut a food product into sticks.

A plurality of knife blades 10 are arranged as illustrated in FIG. 6 in order to cut the food product into sticks. The arrangement comprises a first array 18 having a plurality of knife blades 10 arranged substantially parallel to each other and a second knife array 20 with a plurality of knife blades 10 arranged substantially parallel to each other. The knives may be located such that the cutting edges 12*d* in each array lie in a common plane, or such that the cutting edges 12*d* are non coplanar. Depending upon the desired shape of the sticks, the knife blades in the array 18 may extend generally perpendicular to the knife blades in array 20, as illustrated, or may extend at oblique angles. The food product is conveyed, by known means not illustrated, through the arrays of knives in the direction of arrow 22. By applying a tension force on the order of 1000–1200 pounds to each of the knife blades 10 in the directions of arrows 24 and 26, respectively, in the planes of the respective cutting edges 12*d* in conjunction with the blade thickness t and the cutting edge configuration, it has been found that the food product can be cut into sticks without cracking the surface of the resulting sticks. This has eliminated the problem of "feathering" or "shattering" that has plagued the food processing industry.

Figure 7:
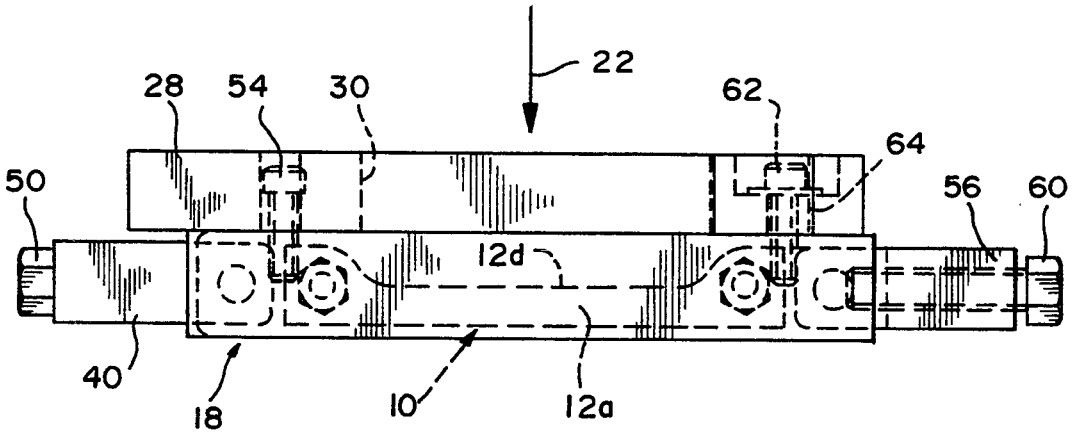
FIG. 7 is a side view of a knife assembly according to the present invention having a single knife array.
Figure 8:
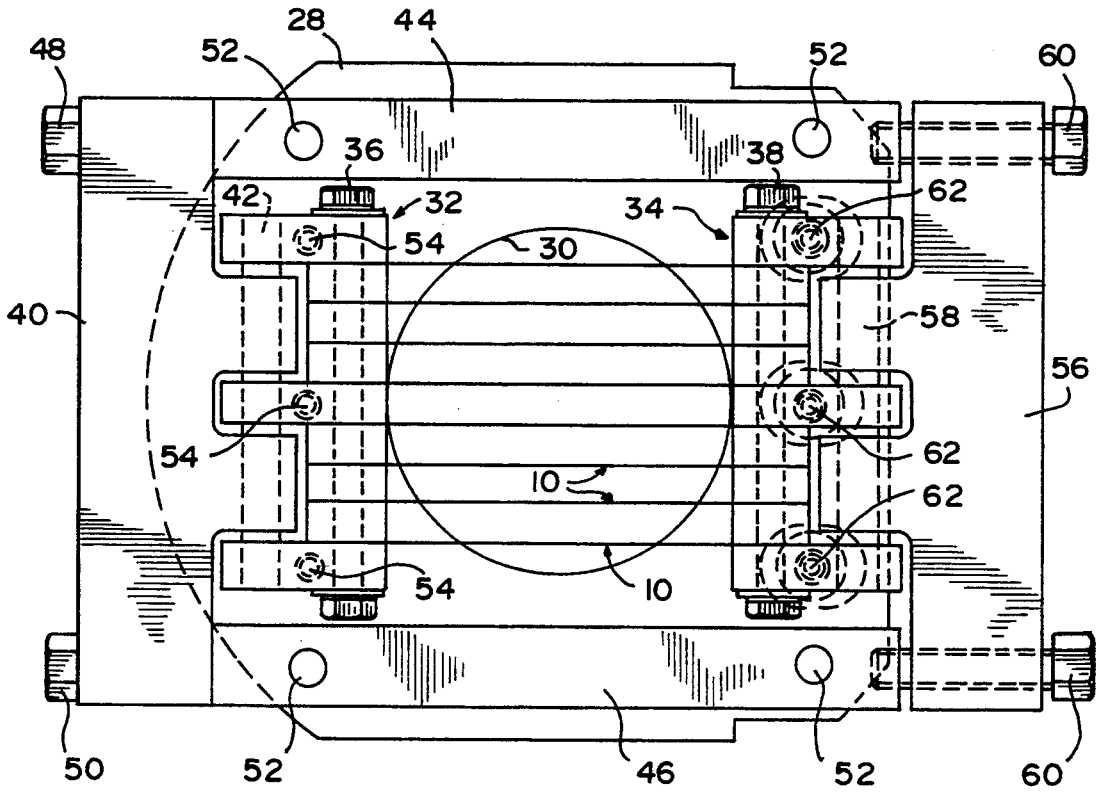
FIG. 8 is a bottom view of the knife assembly of FIG. 7.

Apparatus for mounting the individual knife blades and to apply the requisite tension thereto is illustrated in FIGS. 7 and 8. In these figures, a single knife blade array is illustrated for the purposes of clarity, but it is to be understood that a second knife blade array, of identical construction, is envisioned with the knife blades oriented as illustrated in FIG. 6.

The apparatus comprises a knife blade array 18 mounted to an attaching plate 28 which may be attached to a known food product conveying means such that the food is conveyed through the knife array 18 in the direction of arrow 22. Attaching plate 28 defines opening 30 to enable the food product to pass through the attaching plate 28 into the knife array.

Each knife array may have knife blade mounting members 32 and 34. As can be seen in FIG. 8, the mounting members 32 and 34 have a general "E"-shaped configuration and each are attached to one end of a plurality of knife blades 10. The mounting members 32 and 34 may comprise individual spacers between each of the knife blades 10 so as to evenly space the knife blades across the opening 30. Mounting members 32 and 34 define openings which are placed in alignment with the openings 14 and 16 on the ends of the knife blades. Bolts 36 and 38 may be then passed through the mounting members in each of the individual knife blades to attach these elements together.

Mounting member 32 is, in turn, attached to a stationary member 40 by pin 42 which passes through aligned holes formed in the inter-engaging portions of the stationary member 40 and the mounting member 32. Stationary member 40 is fixedly attached to side rails 44 and 46 by bolts 48 and 50. Side rails 44 and 46 define holes 52 which may be utilized to attach the second knife array to the first knife array 18 such that its blades extend generally perpendicularly to the blades in the knife array 18. Mounting member 32 is also fixedly attached to attaching plate 28 via bolts 54 or the like.

Mounting member 34 is attached to the opposite ends of the knife blades via bolt 38 passing through the holes 16 in the ends of the knife blades and through a corresponding hole in the mounting member 34. Mounting member 34 is, in turn, attached to tension member 56 by pin 58 extending through aligned holes in the inter-engaging portions of the tension member 56 and mounting member 34. Bolts 60 threadingly engage tension member 56 and bear against the end of side rails 44 and 46, respectively. As can be seen, by turning bolts 60, tension member 56 may be caused to move toward the right, as illustrated in FIG. 8, away from the stationary member 40 thereby exerting a tension force on all of the knife blades in the array. Bolts 62, which pass through the attaching plate 28 and threadingly engage the mounting member 34, pass through oblong holes 64 defined by the attaching plate 28 in order to facilitate movement of the mounting member 34 with respect to the attaching plate 28. When sufficient tension has been applied to the knife blades, bolts 62 may be tightened to assist in holding the mounting member 34 in its desired position.

Since the centers of holes 14 and 16 lie in the plane P of the cutting edge 12*d*, the tension exerted on the knife blades 10 by the tension member 56 will be in the plane of the cutting edge.

As can be seen in FIG. 1, the mounting holes 14 and 16 are circular in configuration such that substantially all of the tension force applied to opposite ends of the knife blade 10 is concentrated in the plane P of the cutting edge 12*d*.

The foregoing description is provided for illustrative purposes only and should not be construed as in any way limiting this invention, the scope of which is defined solely by the appended claims.

We claim:

1. A knife blade for a knife assembly to cut food products comprising:

a) a cutting portion having a cutting edge extending in a plane; and, b) mounting portions defining means for applying a tension force to the knife blade substantially in the plane of the cutting edge.

2. The knife blade of claim 1 wherein the means for applying a tension force comprises holes defined by the mounting portions, the centers of the holes lying substantially in the plane of the cutting edge.

3. The knife blade of claim 1 wherein the cutting edge is generally semicircular in cross-sectional configuration.

4. The knife blade of claim 1 wherein the cutting edge is generally flat in configuration.

5. The knife blade of claim 1 wherein the thickness of the cutting portion is less than 0.015 inches.

6. The knife blade of claim 5 wherein the thickness of the cutting portion is between 0.005 and 0.010 inches.

7. The knife blade of claim 6 wherein the thickness of the cutting portion is approximately 0.008 inches.

8. The knife blade of claim 1 wherein at least the cutting portion is formed of stainless steel having a tensile strength of approximately 330,000 psi.

9. The knife blade of claim 8 wherein the stainless steel has a yield strength approximately equal to its tensile strength.

10. A knife blade assembly for cutting a food product comprising:

a) at least one knife blade having a cutting edge extending in a plane;

b) mounting means attached to the at least one knife blade; and, c) tension means operatively associated with the mounting means to apply a tension to the at least one knife blade substantially in the plane of the cutting edge.

11. The knife blade assembly of claim 10 wherein the cutting edge is generally semi-circular in cross-sectional configuration.

12. The knife blade assembly of claim 10 wherein the cutting edge is generally flat in configuration.

13. The knife blade assembly of claim 10 wherein the thickness of the at least one knife blade is less than 0.015 inches.

14. The knife blade assembly of claim 13 wherein the thickness of the at least one knife blade is between 0.005 and 0.010 inches.

15. The knife blade assembly of claim 14 wherein the thickness of the at least one knife blade is approximately 0.008 inches.

16. The knife blade assembly of claim 10 wherein the at least one knife blade has opposite ends and wherein the mounting means comprises:

a) first and second mounting members; and, b) attachment means to attach the first and second mounting members to opposite ends of the at least one knife blade, the attachment means located substantially in the plane of the cutting edge.

17. The knife blade assembly of claim 16 where in the attachment means comprises:

a) first and second holes defined by opposite end portions of the at least one knife blade having centers lying substantially in the plane of the cutting edge; and, b) fastening means extending through the first and second holes so as to attach opposite ends of the at least one knife blade to the first and second mounting members, respectively.

18. The knife blade assembly of claim 16 wherein the tension means comprises:

a) first means operatively associated with the first mounting member to hold the first mounting member substantially stationary; and, b) second means operatively associated with the second mounting member to move the second mounting member away from the first mounting member so as to apply a tension force on the at least one knife blade substantially in the plane of the cutting edge.

19. The knife blade assembly of claim 18 wherein the first means comprises:

a) a stationary member; and, b) second attachment means to attach the stationary member to the first mounting member.

20. The knife blade assembly of claim 18 wherein the second means comprises:

a) a tension member;

b) third attachment means to attach the tension member to the second mounting member; and, c) movement means operatively interposed between the tension member and the stationary member to move the tension member with respect to the stationary member so as to apply a tension force to the at least one knife blade substantially in the plane of the cutting edge.

* * * * *